United States Patent [19]

Iida et al.

[11] 3,935,699

[45] Feb. 3, 1976

[54] DOFFING APPARATUS FOR SPINNING FRAME

[75] Inventors: Makoto Iida, Chigasaki; Akira Kuroda, Osaka, both of Japan

[73] Assignees: Toshiba Seiki Kabushiki Kaisha; Kanebo Kabushiki Kaisha, Tokyo, both of Japan

[22] Filed: Dec. 12, 1974

[21] Appl. No.: 532,292

[30] Foreign Application Priority Data

Dec. 13, 1973 Japan ..... 48-139935

[52] U.S. Cl. ..... 57/52; 57/53

[51] Int. Cl.[2] ..... D01H 9/08

[58] Field of Search ..... 57/52–54

[56] References Cited

UNITED STATES PATENTS

| | | | |
|---|---|---|---|
| 3,370,411 | 2/1968 | Schulz et al. | 57/52 |
| 3,380,238 | 4/1968 | Araki et al. | 57/52 |
| 3,398,519 | 8/1968 | Haussmann | 57/52 |
| 3,681,905 | 8/1972 | Furtmeier et al. | 57/52 X |
| 3,768,680 | 10/1973 | Franklin et al. | 57/52 X |
| 3,791,125 | 2/1974 | Kawakami | 57/52 |
| 3,793,818 | 2/1974 | Yamamoto | 57/52 |

*Primary Examiner*—John Petrakes

*Attorney, Agent, or Firm*—Cushman, Darby & Cushman

[57] ABSTRACT

A doffing apparatus for a spinning frame having bobbin spindles arranged at equal pitch, comprising a movable frame carrying bobbin-chucking means and bobbin-deflecting means, and bobbin-conveying means, said apparatus being operative so that full bobbins from the spinning frame are transferred onto the bobbin-conveying means by said bobbin-chucking means in exchange with the empty bobbins brought by this bobbin-conveying means, without causing any interference, due to the action of the bobbin-deflecting means, between the full bobbins passing from the spinning frame onto the bobbin-conveying means and the empty bobbins being supplied from the conveying means to the spinning frame, thus minimizing the number of steps of doffing operation and the number of parts of the doffing apparatus as a whole.

10 Claims, 21 Drawing Figures

DOFFING APPARATUS FOR SPINNING FRAME

BACKGROUND OF THE INVENTION a. Field of the Invention

The present invention pertains to a doffing apparatus for a spinning frame, and more particularly, it relates to a doffing apparatus for a spinning frame such as a flyer-type roving machine carrying bobbins whose lower end portions are received shallowly in bobbin wheels and whose upper end portions are driven by spindles, said spinning frame being designed to be operative that the bobbins are first relieved of their engagement with said spindles and then they are lifted to some distance above said bobbin wheels to be completely detached from these bobbin wheels during the doffing operation.

b. Description of the Prior Art

As the means for mechanically carrying out doffing operation, there have been proposed doffing apparatuses in, for example, Japanese Patent Publication No. 40-18053 and Japanese Patent Publication No. 48-8298 Specifications. These known doffing apparatuses are invariably arranged to be operative so that, after the full bobbins are taken out of the spinning frame while being supported on appropriate bobbin-supporting means, these full bobbins are transferred onto a bobbin-conveying means disposed close to and alongside the spinning frame, and then empty bobbins which are brought to the side of the spinning frame by the same bobbin-conveying means are received by said bobbin-supporting means to be transferred onto the spinning frame. Thus, the full bobbins which have been removed from the spinning frame can be carried directly to a subsequent step by the bobbin-conveying means and empty bobbins also can be conveyed by the same bobbin-conveying means, whereby these apparatuses have been considered to effectively contribute to rationalization of not only the doffing operation but also the bobbin-conveying operation.

However, the aforesaid known apparatuses have the following problems in both the receiving and transferring of full and empty bobbins between the bobbin-supporting means and the bobbin-conveying means.

That is to say, in that part of operation wherein full bobbins from the spinning frame are transferred onto the bobbin-conveying means by the bobbin-supporting means, it is mandatory that no bobbins are present on the correspondingly positioned bobbin holders of the bobbin-conveying means when the bobbin-supporting means supporting the full bobbins arrive at said bobbin-conveying means. It is also necessary that, by the time the bobbin-supporting means starts to move back to the spinning frame, this supporting means must have already completed the receiving of empty bobbins from the bobbin-conveying means. Because of these requirements, the known apparatuses are of the arrangement that, on the bobbin-conveying means which arrives at the spinning frame, there are interposed unoccupied bobbin holders (meaning carrying no bobbins) between those bobbin holders loaded with the empty bobbins, and that, after full bobbins have been transferred onto these unoccupied bobbin holders by the bobbin-supporting means, said bobbin-conveying means is caused to advance for a distance corresponding to the pitch of one bobbin holder to position the empty bobbins carried on the bobbin-conveying means so as to face the bobbin-supporting means which has already completed the transfer of the full bobbins, and that thereafter these empty bobbins are received by the bobbin-supporting means to be transferred onto the spinning frame.

As such, according to this prior doffing system, there is the inconvenience that, during one doffing operation, the bobbin-conveying means also has to be moved for a predetermined distance in synchronism with the action of the bobbin-supporting means. Thus, the smoothness of the whole operation is hampered, and besides, the control of actions of the apparatus becomes complicated.

Moreover, in the bobbin-conveying means of the known apparatus, a bobbin holder carrying no bobbin requires to be present always for every other bobbin pitch among the row of bobbin holders loaded with bobbins. Therefore, bobbin holders have to be provided on the conveying means in a number twice as many as the number of both full and empty bobbins which are to be conveyed actually. Not only that, there is a further inconvenience that the bobbin-conveying means will become excessively large in size.

SUMMARY OF THE INVENTION

It is, therefore, a primary object of the present invention to provide a doffing apparatus for a spinning frame, which is arranged so that full bobbins from a spinning frame can be transferred onto the bobbin-conveying means in exchange with the empty bobbins brought by this bobbin-conveying means without causing any intereference into the passage of the full bobbins from the spinning frame to the conveying means or the passage of empty bobbins supplied to the spinning frame from the bobbin-conveying means.

Another object of the present invention is to provide a doffing apparatus of the type described, which corrects inconsistency of pitches between the pitch of bobbins on the bobbin-conveying means and the pitch on the bobbin-chucking means provided on a movable frame, and thus can carry out unfailing stable doffing operation.

Still another object of the present invention is to provide a doffing apparatus of the type described, which minimizes the number of steps in the doffing operation and the number of parts of the doffing apparatus.

These as well as other objects, features and advantages of the present invention will become apparent by reading the following statement of preferred embodiments of this invention when taken in conjunction with the accompanying drawings.

BRIEF DESCRIPTION OF THE DRAWINGS

The drawings show a preferred embodiment of the doffing apparatus of the present invention for use with a spinning frame.

DETAILED DESCRIPTION OF THE PREFERRED EMBODIMENT

Figure 1:
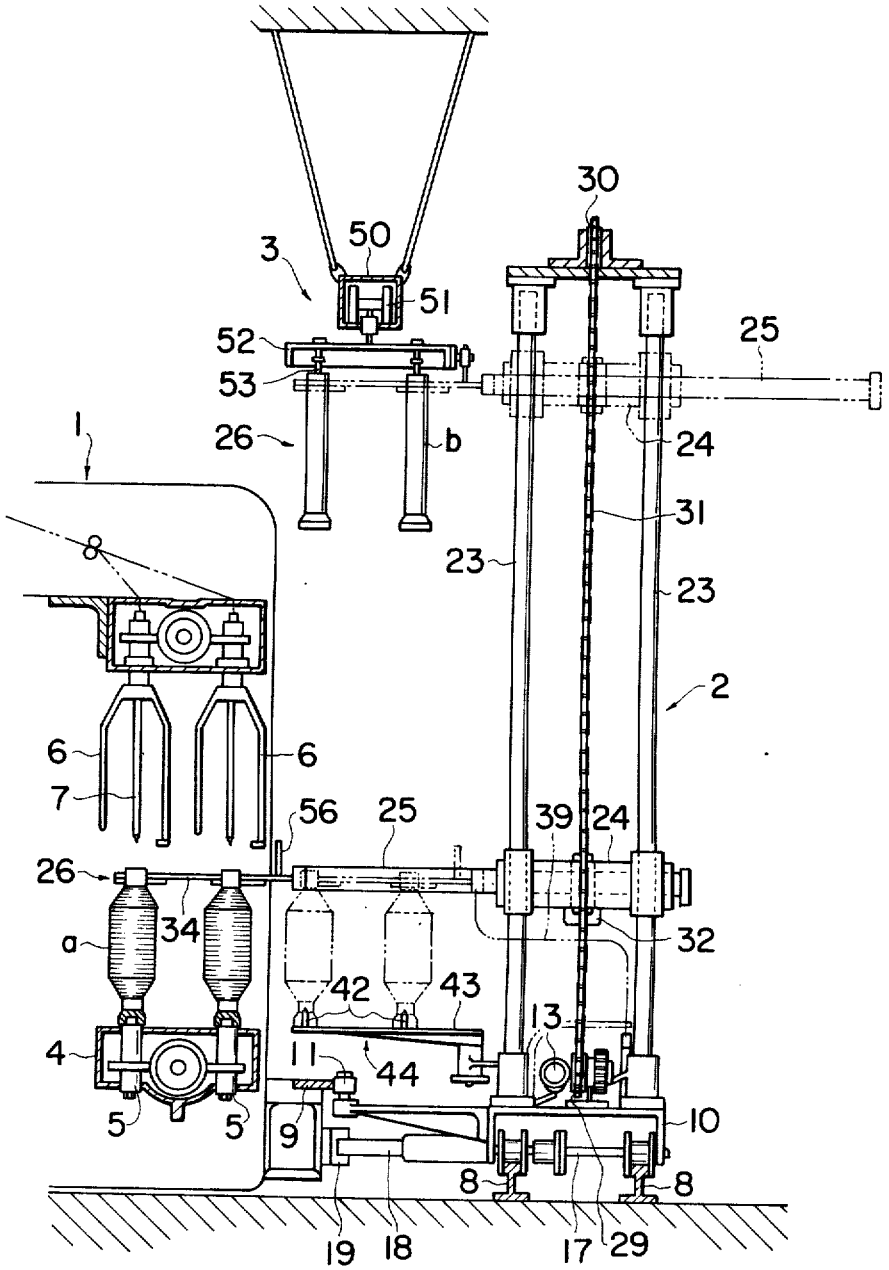
FIG. 1 is an explanatory side view, partly broken away, of a doffing apparatus as a whole according to the present invention.

The present invention will hereunder be described with respect to a preferred embodiment by referring to the drawings.

In FIG. 1, reference numeral 1 represents a roving machine which is shown as an example of spinning frame. Numeral 2 represents a doffing apparatus as a whole. Numeral 3 represents a bobbin-conveying means.

The roving machine 1 illustrated is of the well-known flyer type, in which numeral 4 represents a bobbin rail; 5 represents a bobbin wheel; 6 represents a flyer; and 7 represents a bobbin spindle.

The doffing apparatus 2 as a whole is movably placed on rails 8 and 8 laid on a floor surface along the longitudinal length of the roving machine 1 so as to be able to travel on these rails alongside the roving machine. Also, this doffing apparatus 2 is arranged so that it is ensured to run stably on said rails while being prevented from falling down toward the roving machine, because of the rolling contact between a guide rail 9 which is provided along the front side of the roving machine and a guide roller 11 which is secured to a movable frame 10 of the doffing apparatus 2.

Figure 3:
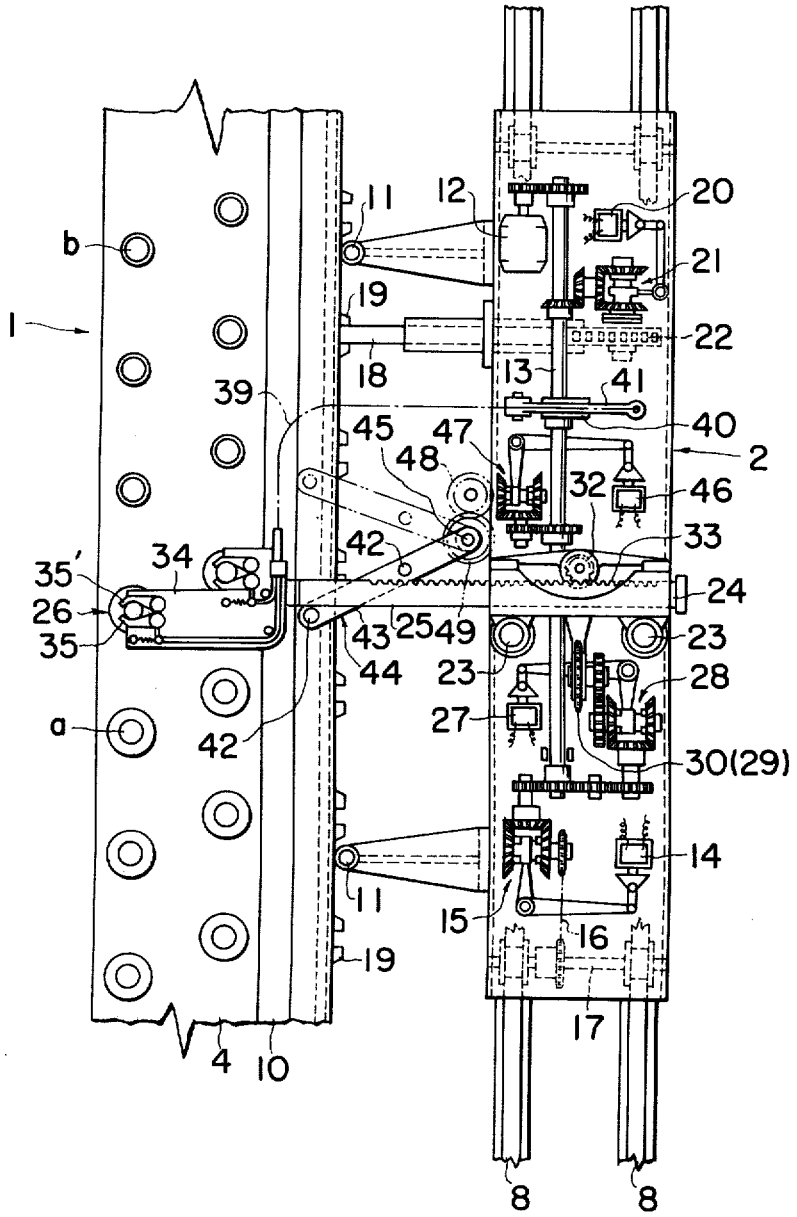
FIG. 3 is a similar plan view, partly broken away, of same.

This doffing apparatus 2 is driven to travel, as shown in FIG. 3, by transmitting the rotation of a main driving shaft 13 which is operatively coupled to an electric motor 12 fixed on the movable frame 10 to a driving shaft 17 provided under this movable frame 10 for the travelling of the movable frame 10, via a clutch 15 which is subjected to connection-changeover operations by a solenoid 14 through a linkage as shown, and via sprockets and chain 16. By a change-over of connection of said clutch 15, either one of two gears as shown is either operably coupled to said driving shaft 17, or set at neutral position, whereby one of the movements, i.e. forward travel, backward travel and stopping, is selected.

On the lower lateral portion of the doffing apparatus 2, there is provided a stopper 18 which is capable of moving toward and away from the roving machine 1. The foremost end of this stopper 18 is caused to engage, in wedge form, into a recess of a block 19 provided on that side of the roving machine 1 facing the doffing apparatus 2 in such a manner as to correspond to the bobbin pitch. Whereby, the halt position of the doffing apparatus 2 relative to the roving machine 1 can be controlled easily.

The movement of said stopper 18 toward and away from the roving machine 1 is performed, as shown in FIG. 3, by transmitting the rotation of said main driving shaft 13 to a rack-pinion portion 22 via a clutch 21 which is subjected to connection-changeover operations by a solenoid 20.

Also, from the movable frame 10 of the doffing apparatus 2 extend a pair of supporting pillars 23 and 23 for a distance sufficiently to correspond to the position of the bobbin-conveying means 3. These supporting pillars 23 and 23 carry a bracket 24 for slidable vertical movement thereon, and this bracket 24, in turn, carries an arm 25 which can freely make forward and backward movements toward and away from the roving machine 1. At the foremost end of this arm 25 is provided a bobbin-chucking means 26 which can chuck two bobbins and let them hang therefrom at the same time.

Figure 2:
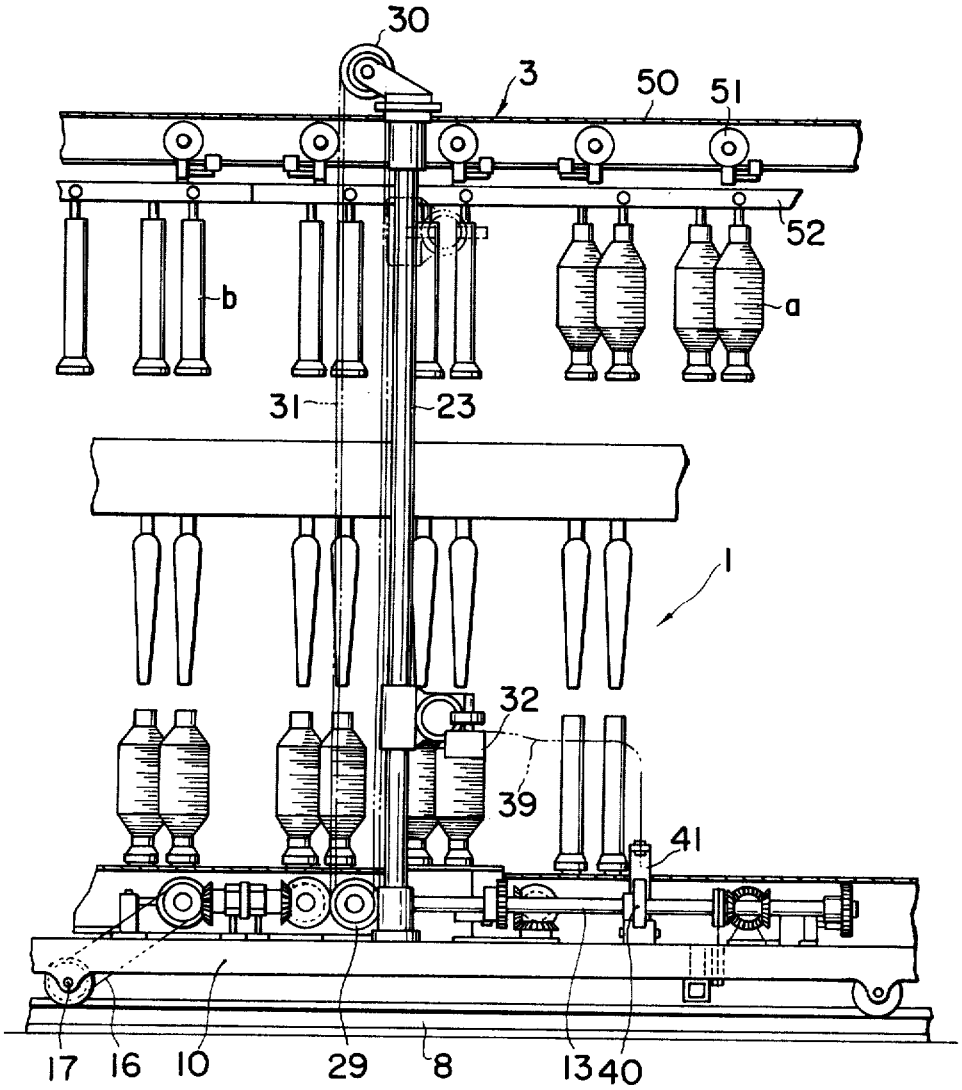
FIG. 2 is a similar front view, partly broken away, of a front view of the whole apparatus of FIG. 1.

The driving of said bracket 24 for making ascending and descending movements is effected, as shown in FIGS. 2 and 3, by transmitting the rotation of said main driving shaft 13 to a sprocket 29 via a required gear selected from among a train of gears by a clutch 28 which, in turn, is adapted to be changed over in its connection by a solenoid 27, and also by the forward as well as the backward run of a chain 31 which is applied between said sprocket 29 and another sprocket 30 provided on top of the supporting pillars 23 and 23. This chain 31 is operably coupled, in its midway, to the bracket 24.

Also, the driving of said arm 25 to make forward and backward movements is accomplished, as shown in FIGS. 1 and 3, by transmitting the rotation of a reversible motor 32 mounted on the bracket 24 to a rack 33 provided on the arm 25, via a pinion.

Figure 4:
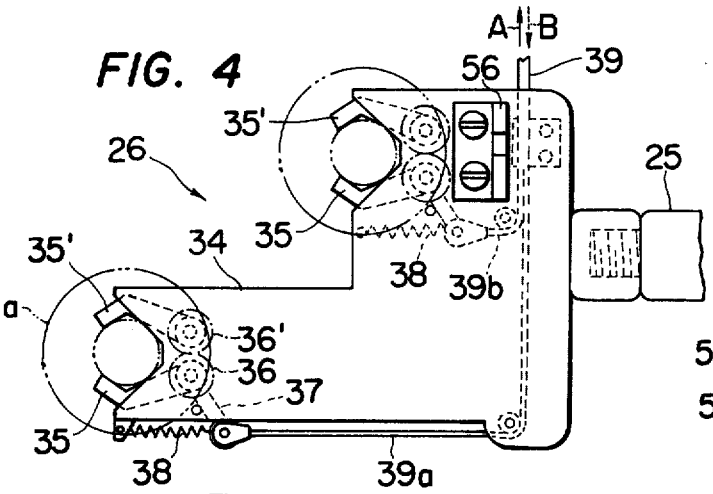
FIG. 4 is a similar plan view, partly broken away, of a bobbin-chucking means of the apparatus.
Figure 5:
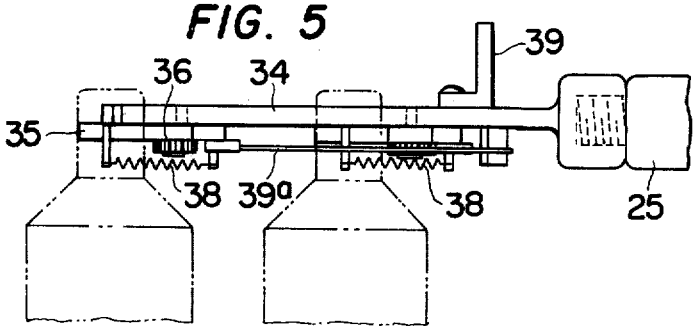
FIG. 5 is an explanatory side view, partly broken away, of said bobbin-chucking means
Figure 6:
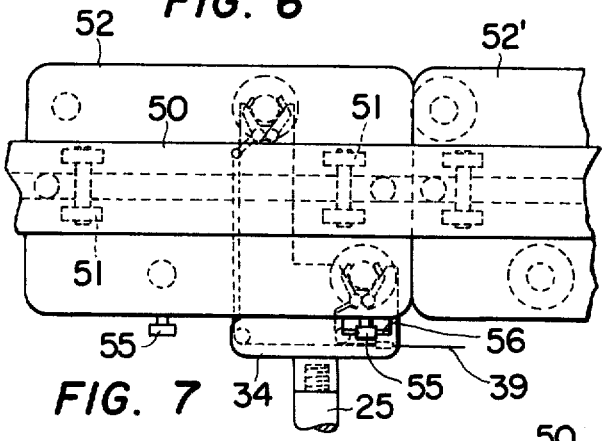
FIG. 6 is another similar plan view of a bobbin-conveying means and a position-correcting means.

As shown on an enlarged scale in FIGS. 4 to 6, each of said bobbin-chucking means 26 is arranged so that two pairs of bobbin chucking members 35, 35′ and 35, 35′ are swingably fastened via shafts to a plate 34 secured to the foremost end of said movable arm 25, and that two pairs of gears 36, 36′ and 36, 36′ which are mounted on said shafts so as to be coupled to said two pairs of chucking members 35, 35′ and 35, 35′, respectively, are meshed with each other, so that by rotating the shaft in each pair of chucking members, these two pairs of chucking members 35, 35′ and 35, 35′ are operated to open and close. A lever 37 extends from the shaft of one 35 of each pair of chucking members 35 and 35′, and a spring 38 is applied between one end of said lever 37 and end of said plate 34 for each pair of chucking members to normally urge each pair of chucking members to close by said spring 38. Also, the two levers 37 and 37 of the bobbin-chucking means are connected to the ends 39*a* and 39*b*, respectively, of a wire 39 which is bifurcated into two branches of wires at a portion close to its end. As this wire 39 is pulled in the direction of the arrow A, the two pairs of chucking members 35, 35′ and 35, 35′ are equally opened.

Said wire 39 is pulled or released by means of a sensing lever 41 which is caused to make swinging movements upwardly and downwardly as this lever is brought into contact with a cam 40 which, in turn, is operatively secured to said main driving shaft 13.

Also, on the side of said doffing apparatus 2 facing the roving machine 1 and at a position near the lower side of said movable arm 25, there is provided a bobbin-deflecting means 44 having a swingable arm 43 provided with pegs 42 and 42 for mounting bobbins thereon at such positions corresponding to the bobbin pitch of said bobbin-chucking means, said pegs 42 and 42 being able to engage both full bobbins and empty bobbins at the lower ends of these bobbins. This bobbin-deflecting means 44, in this example, moves below the movable arm 25 of the bobbin-chucking means 26 as the swingable arm 43 makes a horizontal swinging movement about its fulcrum 45, so that this bobbin-deflecting means 44 can be switched over in its position between a first position at which the pegs are located just below the pairs of bobbin chucks of said bobbin-chucking means and a retiring second position at which this bobbin-deflecting means is away from its first position.

The driving of said swingable arm 43 for making swinging movements is performed in the following manner. That is, as shown in FIG. 3, the rotation of said main driving shaft 13 is transmitted to a gear 48 via a clutch 47 whose connection is switched over by a solenoid 46 to thereby rotate the arm 43 either to the left side or to the right side via a gear 49 meshed with said gear 48.

Figure 8:
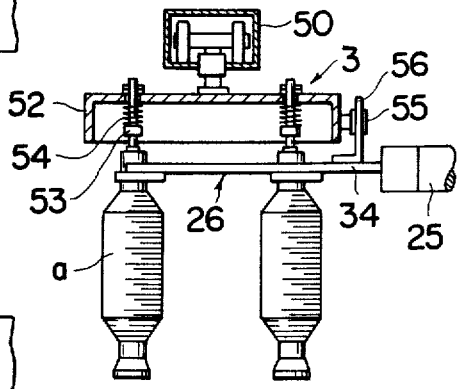
FIG. 8 is a similar side view, partly broken away, of same.
Figure 7:
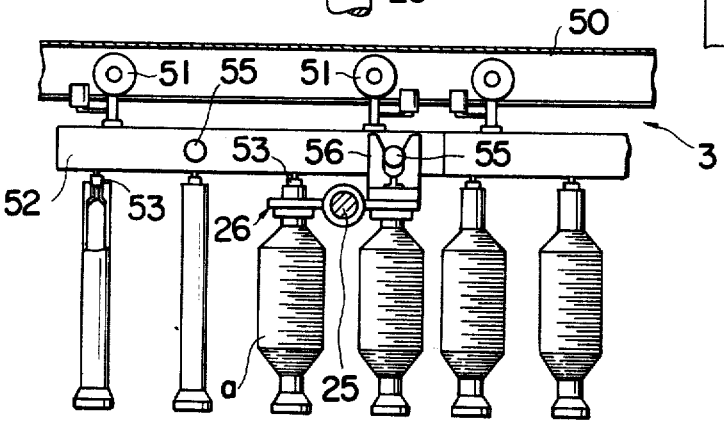
FIG. 7 is a similar front view of same.

The bobbin-conveying means 3 is of the arrangement that, as shown in FIGS. 6 through 8, a plurality of supporting means, which in this embodiment are conveying parettes 52, are suspended via rollers 51, 51, .... from a common rail 50 which, in turn, is fixedly suspended from the ceiling of a construction wherein the doffing apparatus 2 is installed. A plural pairs of bobbin holders 53 and 53 are secured to the lower surface of each conveying parette 52 at such an interval as is equal to the pitch of the bobbin chucking member of the bobbin-chucking means 26.

The aforesaid bobbin holder 53 preferably is of the arrangement that it can be switched over from its bobbin-holding position to its position of releasing this bobbin and vice versa for each pushing-up action applied to this bobbin holder 53 from below, as is stated for example in U.S. Pat. No. 3,512,731 Specification. As shown in FIG. 8, the bobbin holder 53 is mounted on said conveying parette 52 and is constructed in such a way that it can make vertical movements for a predetermined distance. Between the parette 52 and the bobbin holder 53 is applied a relatively powerful spring 54 which will not be displaced in its position by the mere pushing-up force which is applied to the bobbin holder 53 at each time the bobbin is fit into this holder and is pulled off therefrom.

On one side of the conveying parette 52, there are provided a plurality of pin-shaped projections 55 at a predetermined pitch for positioning the bobbin holders relative to the main body of the doffing apparatus 2. On the ohter hand, on the plate 34 of the bobbin-chucking means 26 of said doffing apparatus 2, there is provided a generally U-shaped cam plate 56 which is assigned to guide a corresponding one of said projections 55 to be engaged into this cam plate to be nipped therein. The positioning means comprising these projections and nipping cam plate are intended to bring the supporting means, i.e. the conveying parette 52 of the conveying means 3 into correct position relative to the bobbin-chucking means 26.

It should be noted that said bobbin-chucking means 26 is displaceable horizontally between a first horizontal position corresponding to the position of one of said bobbin holders and a second horizontal position located at a bobbin carried on the spinning frame, and at the same time displaceable vertically between a third vertical position corresponding to the upper end portion of the bobbin carried on the spinning frame and a fourth vertical position corresponding to the upper end portion of the bobbin suspended from said one of the bobbin holders, to assume such a position at a time as is defined by any one horizontal position plus any one vertical position selected from the above four positions.

The doffing apparatus according to the present invention is of such arrangement as stated above. Next, its doffing operation will be explained in sequential order of the operation by referring to FIGS. 10 through 16.

Figure 10:
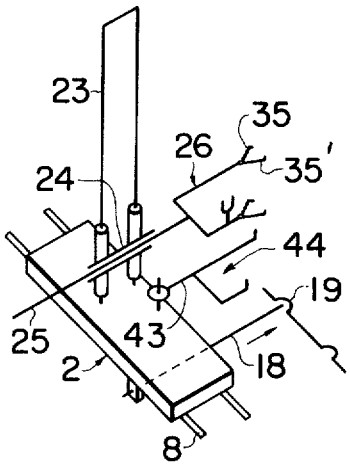
FIGS. 10 to 16 are somewhat schematic explanatory perspective views showing the sequential doffing actions of the apparatus.

1. FIG. 10 shows the state of the doffing apparatus 2 when the stopper 18 thereof plunges forwardly and engages in the recess of the block 19 of the roving machine 1, whereby the doffing apparatus 2 is set at a predetermined doffing position.

At such moment, the bobbin-chucking means 26 provided at the foremost end of the arm 25 has already been brought into its completely retreated position (defined by a first horizontal position) at a predetermined vertically low level (defined as a third vertical position), so that at this state the bobbin-chucking means 26 assumes a position which will be defined by a first horizontal position plus a third vertical position. On the other hand, the bobbin-deflecting means 44 is set at a position which is just below this bobbin-chucking means 26, and this position will be defined as a first position of the deflecting means 44.

At this moment, with respect to the bobbin-conveying means 3, a group of conveying parettes 52, .... carrying empty bobbins *b*, .... suspended therefrom have been already sent back from a subsequent step and they are at rest at the predetermined doffing positions, respectively.

Figure 11:
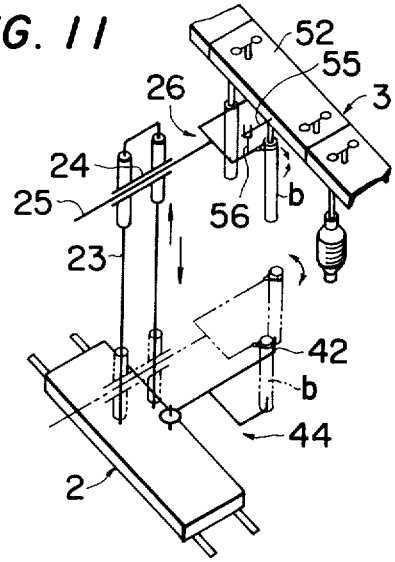

2. Next, as shown in FIG. 11, by causing the bracket 24 to ascend along the supporting pillars 23 and 23, said bobbin-chucking means 26 is accordingly lifted up to a position at which it is able to chuck the upper ends of the two empty bobbins *b* and *b* supported by said conveying parette 52, or in other words, up to a position corresponding to the doffing position, and thereafter this means 26 is caused to stop at this position (defined as a first horizontal position plus a fourth vertical position).

It should be understood that, even if the position of the conveying parette 52 is somewhat displaced in the direction of conveyance relative to the doffing apparatus 2, the cam plate 56 coupled to the plate 34 of the bobbin-chucking means 26 will, when this means 26 has ascended, engage the projection 55 which is provided on the conveying parette and said projection will be received into the center of the U-shaped cam plate 56, while being guided by this U-shape, as shown in FIG. 7. Thus, the conveying parette 52 is controlled of its position in order to correct such inconsistency in the relative positions and it is thus placed at the predetermined doffing position.

Next, by operating the wire 39 of the bobbin-chucking means 26 in the slackening direction B, the respective pairs of bobbin-chucking members 35, 35' and 35, 35' are closed by the springs 38 and 38, respectively, to thereby chuck the upper end portions of the empty bobbins *b* and *b*. Thereafter, the bobbin-chucking means 26 holding these empty bobbins *b* and *b* is lifted again for a short distance to thereby release the empty bobbins *b* and *b* from the bobbin holders 53 and 53. and then, the bracket 24 carrying the chucking means 26 is caused to descend and is stopped at a position at which the lower end portions of the empty bobbins *b* and *b* suspended from the bobbin-chucking means 26 are to be engaged by the pegs 42 and 42 provided on the arm 43 of the bobbin-deflecting means 44. The chucking means 26 is now at a position defined by a first horizontal position plus a third vertical position. At this moment, the wire 39 is pulled in the direction of the arrow A so that the respective bobbin-chucking members 35 and 35′ are opened to cause the empty bobbins *b* and *b* to be deposited and supported on the pegs 42 and 42, respectively.

Figure 12:
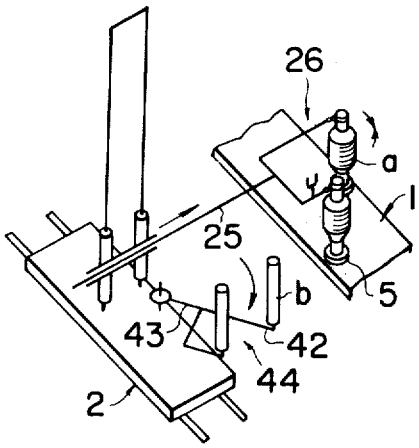
Figure 13:
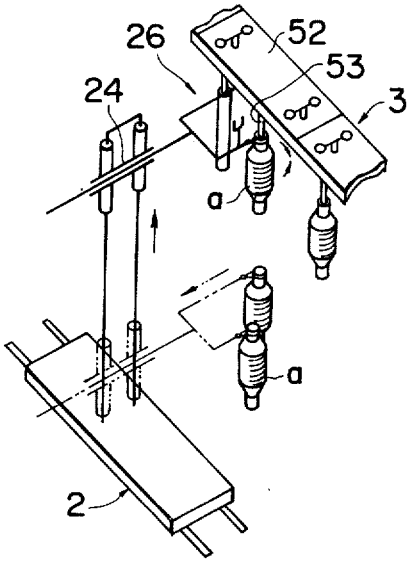

3. After these empty bobbins have been placed on the bobbin-deflecting means 44, the bobbin-chucking means 26 in its open state is lifted upwardly until it becomes out of contact with the upper end portions of the empty bobbins *b* and *b* supported on the bobbin-deflecting means 44. Then, by causing the arm 25 to thrust forwardly as shown in FIG. 12, the bobbin-chucking means 26 is moved to a position corresponding to the upper end portions of the full bobbins *a* and *a* which are being received in the bobbin wheels 5 and 5 provided on the bobbin rail 4 of the roving machine 1. Thereafter, the bobbin-chucking means 26 is slightly lowered in its position and is stopped at a position at which the chucking members of the bobbin-chucking means 26 are able to chuck the upper end portions of the full bobbins *a* and *a*. The bobbin-chucking means 26 now assumes a position which will be defined as a second horizontal position plus third vertical position. Then, by slackening the wire 39 as stated previously, these full bobbins *a* and *a* will be chucked by the chucking members 35 and 35′ and will thus be supported thereby.

Along therewith, the movable arm 43 of the bobbin-deflecting means 44 is given a clockwise rotation to thereby bring the empty bobbins *b* and *b* carried thereon to move to a deflected position offset from the path of movement of the bobbin-chucking means 26. This position is defined as a second position of the deflecting means 44.

4. Then, the bracket 24 is lifted upwardly to a short distance while its bobbin-chucking means 26 is in the state of chucking the full bobbins *a* and *a* still supported on the bobbin rail 4, to thereby release the lower end portions of the full bobbins *a* and *a* off the bobbin wheels 5 and 5. Thereafter, the arm 25 is caused to retreat back to the position (said a first horizontal position) shown in phantom line in FIG. 13 to place the bobbin-chucking means 26 at a position (said a third vertical position) just below the conveying parette 52.

Then, the bracket 24 and accordingly the bobbin-chucking means 26 carrying the full bobbins is lifted upwardly and is stopped at such a position (which will be defined by a first horizontal position and a fourth vertical position) at which the upper end portions of the full bobbins *a* and *a* are to be transferred onto the now unoccupied bobbin holders 53 and 53 which have already trandferred the empty bobbins *b* and *b* onto the bobbin-chucking means 26. At this position of the bobbin-chucking means 26, the upper end portions of the full bobbins *a* and *a* are pushed upwardly into contact with the bobbin holders 53 and 53 to be received in said holders. Thereafter, the bobbin-chucking members 35 and 35′ are opened.

Figure 9:
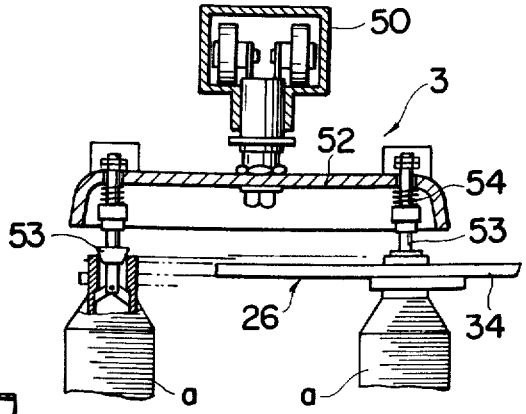
FIG. 9 is a similar side view, partly broken away, of a bobbin holder showing its operative state.

It should be understood that at such a moment of operation, all of the full bobbins *a* and *a* which are being chucked by the bobbin-chucking means 26 are not necessarily brought exactly to such a vertical positional level as is sufficient for these bobbins to contact all of the bobbin holders 53 and 53. It may happen that either one of the full bobbins *a* and *a* is brought earlier into contact with one of the bobbin holders 53 before the other bobbin *a* contacts the other bobbin holder 53. Even in such an instance, that bobbin holder 53 which has already performed the holding action earlier is moved upwardly further against the force of the spring 54 as shown in FIG. 9, and thus the attachment of the other full bobbin to the other bobbin holder 53 is carried out smoothly without any problem.

Figure 14:
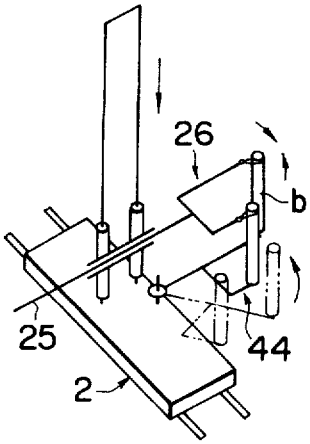

5. Upon completion of the transfer of the full bobbins onto the conveying parette 52 in the manner as stated above, the arm 43 of the bobbin-deflecting means 44 which is positioned at a low position (said a second position) is rotated counter-clockwise as shown in FIG. 14, to thereby bring the empty bobbins *b* and *b* supported on the pegs 42 and 42 to a position at which these empty bobbins *b* and *b* are to be transferred on to the bobbin-chucking means 26. Thereafter, the bracket 24 is lowered in its position.

When the bobbin-chucking means 26 which has thus been lowered in its position arrives just at a position (said first horizontal position) corresponding to the upper ends of the empty bobbins *b* and *b* carried on the bobbin-deflecting means 44, this means 26 is caused to stop its movement, and along therewith the bobbin-chucking members 35 and 35′ of this means 26 are closed to thereby chuck the upper end portions of the empty bobbins *b* and *b*. Upon completion of this action of chucking the empty bobbins *b* and *b*, the bobbin-chucking means 26 is lifted upwardly to a short distance to detach these empty bobbins *b* and *b* from the pegs 42 and 42 on which these empty bobbins have been standing.

Figure 15:
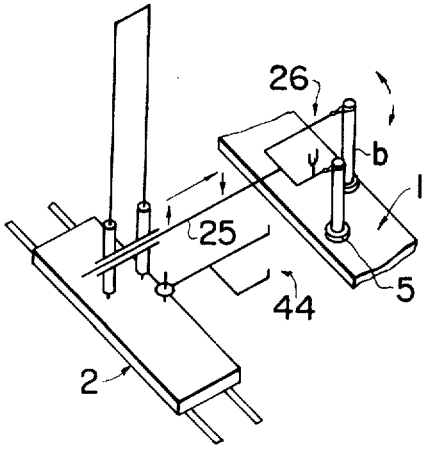

6. Next, as shown in FIG. 15, the arm 25 is caused to advance until the empty bobbins *b* and *b* which are being supported on the bobbin-chucking means 26 are positioned on the now unloaded bobbin wheels 5 and 5. The arm 25 is caused to pause at such position stated above, and then it is lowered from that position to cause the lower end portions of the empty bobbins *b* and *b* to be received in the bobbin wheels 5 and 5, while opening the chucking members 35 and 35′. This position of the bobbin-chucking means is defined by the combination of a second horizontal position plus a third vertical position.

Figure 16:
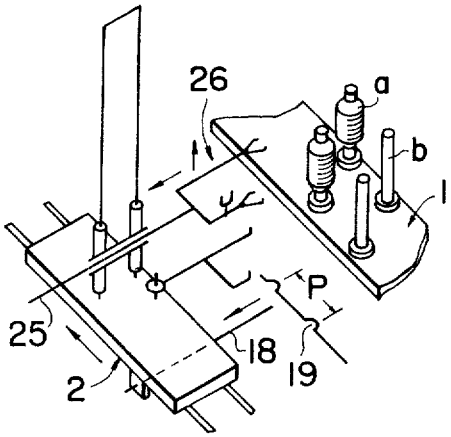

7. After the completion of the supply of empty bobbins to the roving machine 1, the bobbin-chucking means 26 is lifted upwardly from its position corresponding to the doffing position, and then as shown in FIG. 16, the arm 25 of this means 26 is again caused to retreat back to its position of retreat.

Along therewith, the stopper 18 is caused to retreat to disengage from the recess in the block 19, and the doffing apparatus 2 is caused to make a forward run for a predetermined pitch P and to stop at a next doffing position. Then, the stopper 18 is again moved forwardly to engage in the recess in the next block 19 to perform the positioning.

With the foregoing actions of the parts, the doffing operation shown in FIG. 1 is completed. Thereafter, these actions are repeated. When all of the full bobbins *a*, . . . . have been replaced by all of the empty bobbins *b*, . . . . carried on the conveying parette 52, the group of conveying parettes 52, . . . . which are loaded with full bobbins *a*, . . . . are moved onto the subsequent step, and along with this, the doffing apparatus 2 is caused to make a backward travel up to the initial awaiting position so as to be ready for the next doffing operation. Also, the group of conveying parettes 52, . . . . carrying empty bobbins thereon are brought into the required position by the time the next doffing operation starts.

Basic actions of the doffing apparatus of the present invention have been described above. It should be understood, however, that in such an instance wherein the bobbin pitch on the roving machine 1 is not identical with the bobbin pitch in the subsequent step, the operation at such an instance will be performed as follows. In case, for example, bobbins are conveyed between a roving machine of a large bobbin pitch and spinning frame of a small bobbin pitch the bobbin pitch of the conveying parette 52 is adjusted beforehand to match the bobbin pitch of the spinning frame which constitutes the subsequent step. In such an instance, however, pitch-matching operation will become necessary in addition to the afore-stated actions of the doffing apparatus. This additional operation will be performed as stated below.

As shown in FIGS. 17A through 17E, a stopper 57 different from the aforesaid stopper 18 is provided on the doffing apparatus 2, and also projections 58, . . . . are provided on that side of the conveying parette 52 facing the doffing apparatus for each bobbin pitch $P_2$ thereof. At the time of doffing operation, the center $X_1$ of each leading bobbin among the bobbins carried on each conveying parette 52 is, in its rest position, in register with the center of the leading bobbin among the bobbins carried on the roving machine 1 corresponding to one doffing of the bobbins for this single conveying parette 52.

Figure 17A:
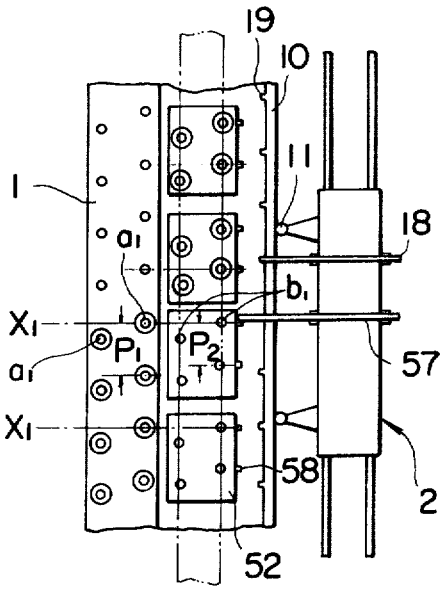
FIGS. 17A to 17E are somewhat schematic, explanatory plan views showing the sequential operations for pitch-matching between said bobbin-conveying means and a main body of said doffing apparatus.
Figure 17B:
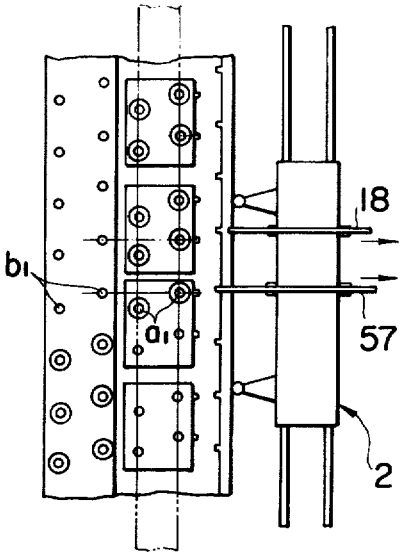
Figure 17C:
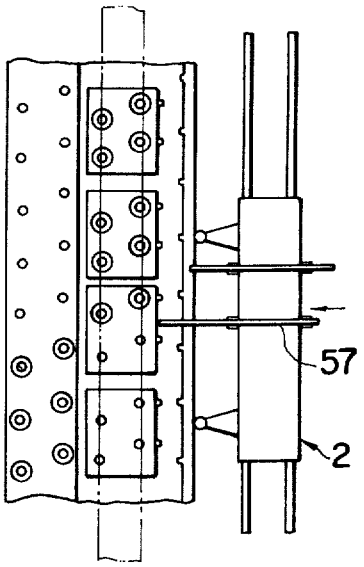
Figure 17D:
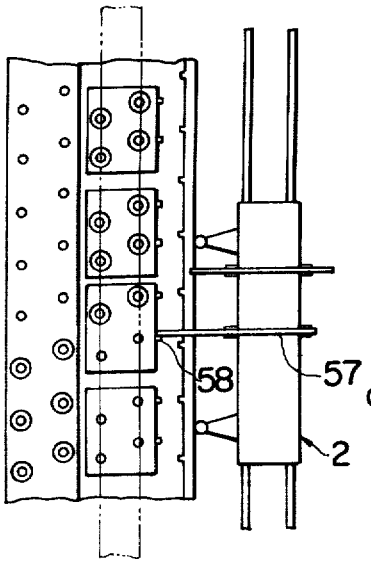
Figure 17E:
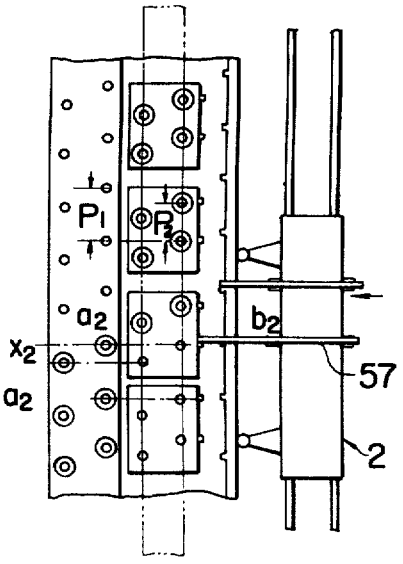

When, in the state as shown in FIG. 17A, the replacement between the full bobbins $a_1$ and $a_1$ and the empty bobbins $b_1$ and $b_1$ completes, both of the stoppers 18 and 57 are caused to retreat in their positions as shown in FIG. 17B. During the movement of the doffing apparatus 2 for a distance corresponding to one pitch $P_1$ on the roving machine 1, the stopper 57 is caused to thrust as shown in FIG. 17C and thereby the projection 58 of the conveying parette 52 is engaged by the stopper 57 and anchored as shown in FIG. 17D. The doffing apparatus 2 is moved further. Whereby, when the doffing apparatus 2 has arrived at the next doffing position, the center $X_2$ of the next bobbin carried on the conveying parette 52 is rendered in register with the center of the next bobbin carried on the roving machine 1. Thus, the apparatus will assume the condition that the replacement between the full bobbins $a_2$ and $a_2$ and the empty bobbins $b_2$ and $b_2$ are possible. After this, the conveying parette 52 is moved, in the similar manner as has been stated above, for a distance corresponding to the difference $P_1$-$P_2$ between the pitch $P_1$ on the roving machine 1 and the pitch $P_2$ on the conveying parette 52, for each single doffing operation. Thus, alteration of bobbin pitch from the pitch $P_1$ to the pitch $P_2$ is carried out.

The doffing apparatus according to the present invention has been described above. This doffing apparatus, however, may be of the arrangement as will be stated below.

a. In the aforesaid embodiment, empty bobbins *b*, . . . . are first deflected by the bobbin-deflecting means 44. However, conversely, full bobbins *a*, . . . . may be taken out first from the spinning frame 1 and deflected by the deflecting means.

b. The locations at which the bobbin-conveying means 3 and the bobbin-deflecting means 44 are provided and the configurations of these means are not limited to those illustrated. Instead, for example, the bobbin-conveying means 3 may be of the type designed to run on the floor surface, and also the bobbin-deflecting means 44 may be of a suspendion-deflecting type.

c. The bobbin-chucking means 26 does not need to be of the type designed to move rectilinearly. Depending on the location at which the bobbin-conveying means 3 is disposed, this means 26 may make arcuate movements, i.e. its arm 25 may be designed to make swinging movements.

d. The deflecting movement of the bobbin-deflecting means 44 is intended to deflect the bobbins which are held temporarily by this means 44 so as not to hinder the movement of those bobbins supported on the bobbin-chucking means 26. In addition to the arrangement of the deflecting means 44 as shown which is designed for deflecting the bobbins sideways, the means 44 may move vertically or in any other directions.

As stated above with respect to the preferrred embodiment and its modifications, the doffing apparatus according to the present invention features that a bobbin-deflecting means 44 is provided at a certain location in the predetermined course of movement of the bobbin-chucking means which performs the conveyance of bobbins between the doffing position on the spinning frame and the doffing position on the bobbin-conveying means, to deflect temporarily the bobbins which are to be conveyed. Furthermore, this bobbin-deflecting means is arranged so that it can be moved between a first position of doffing bobbins with the bobbin-chucking means and a second deflecting position displaced from said first position. With the doffing apparatus arranged as stated above, one of the two kinds of bobbins intended to be replaced, i.e. empty bobbins and full bobbins, are temporarily held and deflected by the bobbin-deflecting means to a position outside of the path of movement of the bobbin-chucking means. Whereby, it is possible to easily and freely convey the other one of said two kinds of bobbins intended to be replaced, i.e. full bobbins and empty bobbins, between the predetermined doffing positions to place these bobbins directly onto a site which is then not occupied by bobbins because the otherwise interfering bobbins have been already deflected to a non-interfering position. As a result, it is possible to completely eliminate such troublesome steps of the known art as additionally providing unoccupied bobbin holders on the bobbin-conveying means and setting these unoccupied bobbin holders at predetermined positions by moving this bobbin-conveying means during one cycle of doffing operation. Furthermore, as stated avove, since there is no need of preparing unoccupied bobbin holders for the doffing operation, the construction of the bobbin-conveying means required for conveying a predetermined number of bobbins can be greatly simplified.

In addition, while this invention ensures that the deflected bobbins will never stand in the way of the travel of the other group of bobbins owing to the positional deflection performed by the bobbin-deflecting means, this bobbin-deflecting means is brought back to its initial position to thereby place the deflected bobbins back into the path of movement of the bobbin-chucking means, thus enabling these brought-back bobbins to be placed easily to another required position during the next movement of the bobbin-chucking means. As a result, a required doffing can be performed easily and smoothly only by relatively simple movements without forcing the bobbin-chucking means to carry out complicated actions.

We claim:

1. An apparatus for doffing bobbins for a spinning frame having a plurality of bobbin spindles arranged, at a predetermined equal pitch, along the longitudinal length of said spinning frame, comprising:

a movable frame movable on rails laid on a floor surface along the longitudinal length of a spinning frame, pillars extending from said movable frame, bobbin-chucking means vertically slidably carried on said pillars and having a horizontally movable arm and having at least one bobbin chuck at the forward end of this movable arm, bobbin-deflecting means movably arranged on said movable frame for moving between a first position located just below said at least one bobbin-chuck and a second position located away from said first position when viewed from thereabove, and bobbin-conveying means movable on a fixed rail provided above said bobbin-chucking means along the longitudinal length of the spinning frame, and having a plurality of bobbin holders suspended in row from supporting means provided thereon, said bobbin-chucking means being displaceable horizontally between a first horizontal position corresponding to the position of one of said bobbin holders and a second horizontal position located at a bobbin carried on the spinning frame, and at the same time being displaceable vertically between a third vertical position corresponding to the upper end portion of the bobbin carried on the spinning frame and a fourth vertical position corresponding to the upper end portion of the bobbin suspended from said one of the bobbin holders, to assume such a position at a time as is defined by any one horizontal position plus any one vertical position selected from the above four positions;

said apparatus being arranged to perform the following eight sequential interlocked actions as one cycle of the doffing operation:

a first action of removing empty bobbins from said bobbin holders of said bobbin-conveying means when said at least one bobbin chuck assumes its first horizontal position and its fourth vertical position, a second action of transferring these empty bobbins onto said bobbin-deflecting means when said at least one bobbin chuck assumes its first horizontal position and its third vertical position and when said deflecting means assumes its first position, a third action of deflecting the position of said bobbin-deflecting means into its second position, a fourth action of catching the full bobbins from the spinning frame when said at least one bobbin chuck assumes its second horizontal position and its third vertical position, a fifth action of transferring these full bobbins onto the bobbin holders of the bobbin-conveying means when said at least one bobbin chuck assumes its first horizontal position and its fourth vertical position, a sixth action of bringing said bobbin-deflecting means back to its first position, a seventh action of removing empty bobbins from said bobbin-deflecting means carrying these empty bobbins thereon when said at least one bobbin chuck assumes its first horizontal position and its third vertical position, and an eighth action of transferring these empty bobbins onto the spinning frame when said at least one bobbin chuck assumes its second horizontal position and its third vertical position.

2. An apparatus according to claim 1, arranged so that said third action and said fourth action are performed at the same time.

3. An apparatus according to claim 1, arranged so that said third action is performed after said fourth action.

4. An apparatus according to claim 1, arranged so that said fifth action and said sixth action are performed at the same time.

5. An apparatus according to claim 1, arranged so that said fifth action is performed after said sixth action.

6. An apparatus according to claim 1, in which said supporting means of said bobbin-conveying means comprises a plurality of parettes.

7. An apparatus according to claim 1, further comprising positioning means for positioning said movable frame to the spinning frame so that said at least one bobbin chuck is positioned in register with said bobbin spindles.

8. An apparatus according to claim 7, in which said positioning means comprises a retractable stopper provided on that side of the movable frame facing said spinning frame and engageable in any one of a plurality of recesses formed on that side of the spinning frame facing this apparatus at equal interval corresponding to the pitch of the bobbin spindles.

9. An apparatus according to claim 1, further comprising position-correcting means for correcting the relative position between said supporting means of the bobbin-conveying means and said bobbin-chucking means.

10. An apparatus according to claim 9, in which said position-correcting means comprises projections provided on one side of said supporting means at an interval corresponding to the bobbin pitch or full-integer multiples of that pitch.

* * * * *